US005544587A

United States Patent [19]

Thiesen et al.

[11] Patent Number: 5,544,587

[45] Date of Patent: Aug. 13, 1996

[54] CANNON AMMUNITION HAVING COMBUSTIBLE CARTRIDGE CASE

[75] Inventors: Stefan Thiesen, Willich; Eckhard Rahnenführer, Dormagen; Josef Köhler, Ampfing, all of Germany

[73] Assignees: Rheinmetall Industrie GmbH, Ratingen, Germany; WNC Nitrochemie GmbH, Aschau a. Inn, Germany

[21] Appl. No.: 354,824

[22] Filed: Dec. 8, 1994

[30] Foreign Application Priority Data

Dec. 13, 1993 [DE] Germany ..... 43 42 428.7

[51] Int. Cl.[6] ..... F42B 5/18

[52] U.S. Cl. ..... 102/431; 102/470; 102/700

[58] Field of Search ..... 102/431–433, 102/470, 700, 467

[56] References Cited

U.S. PATENT DOCUMENTS

| | | | |
|---|---|---|---|
| 3,486,451 | 12/1969 | Moore et al. | 102/433 |
| 3,513,776 | 5/1970 | Driscoll | 102/431 |
| 3,598,052 | 8/1971 | Schwartz et al. | 102/431 |
| 3,771,451 | 11/1973 | Woodring | 102/430 |
| 3,832,951 | 9/1974 | Katz et al. . | |
| 4,480,551 | 11/1984 | LoFiego | 102/245 |
| 4,572,078 | 2/1986 | Bell . | |
| 4,709,636 | 12/1987 | Mueller et al. | 102/431 |
| 5,069,133 | 12/1991 | Canterberry et al. | 102/331 |
| 5,088,412 | 2/1992 | Patrichi | 102/202.5 |
| 5,237,927 | 8/1993 | Gonzalez et al. . | |
| 5,237,928 | 8/1993 | Redecker | 102/431 |

FOREIGN PATENT DOCUMENTS

| | | |
|---|---|---|
| 0410075 | 1/1991 | European Pat. Off. . |
| 2720695 | 11/1978 | Germany . |
| 3334026 | 4/1985 | Germany . |
| 3442741 | 5/1986 | Germany . |
| 3927400 | 8/1989 | Germany . |
| 8804651 | 9/1989 | Germany . |
| 2278666 | 12/1994 | United Kingdom . |

OTHER PUBLICATIONS

Meyer, Rudolf, "Explosiv Stoffe", *VERLAG CHEMIE*, 1973, pp. 10–13, 206–207, 220–221.

RHEINMETALL GmbH, "Waffentechnisches Taschenbuch", [*Handbook on Weaponry*], Ed. 7, 1980, pp. 582–585.

*Primary Examiner*—Harold J. Tudor

*Attorney, Agent, or Firm*—Spencer & Frank

[57] ABSTRACT

In cannon ammunition including a cartridge case containing a propellant charge, a case bottom to which the cartridge case is connected, a charge igniter, and a primmer element positioned in the case bottom, the improvement in which the cartridge case is combustible, is connected to the primer element, and includes a combustible material and a pyrotechnical mixture which is embedded within the combustible material and which is composed of at least one reducing agent and at least one oxidizing agent which form a pyrotechnical redox system; and the charge igniter consists of the cartridge case.

21 Claims, 2 Drawing Sheets

CANNON AMMUNITION HAVING COMBUSTIBLE CARTRIDGE CASE

BACKGROUND OF THE INVENTION

1. Field of the Invention

The invention relates to cannon ammunition having a combustible cartridge case and a charge igniter which is in operational connection with an ignition apparatus disposed at the breechblock end of the cannon, wherein a pyrotechnical mixture having an oxygen carrier is contained in the cartridge case and the components of the pyrotechnical mixture form a pyrotechnical redox system.

2. Description of the Related Art

Ammunition of this type is known from, for example, DE 39 27 400 A1. In this case, the cartridge case of the corresponding cartridge, or of the respective propellant container (in the case of artillery ammunition), comprises a combustible plastic shrink film. To achieve the most complete combustion possible of the cartridge case, a pyrotechnical mixture of sub-stoichiometrically hydrated titanium subhydride and an oxygen carrier containing a nitrate/nitrite is contained as a combustion aid within the shrink film. A centrally-arranged, relatively long charge igniter for igniting the charge is located in the cartridge case.

Among the disadvantages of this type of ammunition is that the charge igniter requires a relatively large amount of space because it must have a certain minimum length. Particularly in the use of tank ammunition having impact projectiles, the penetrators are increased in length with regard to measures performed on the projectile to increase efficiency, so that the projectile would have to reach further and further into the cartridge case while at the same time a predetermined cartridge length would be maintained. This space is, however, not available for the penetrators because of the minimum length of the charge igniters.

It has, therefore, already been proposed not to use a central charge igniter for ignition, but to use propellant rods disposed at the inside wall of the cartridge case. However, such burn-through charges require complex handling. In addition, they reduce the chamber necessary for the main charge, thus causing a loss of efficiency.

It is therefore the object of the invention to disclose cannon ammunition having a combustible cartridge case, in which reliable and rapid ignition of the propellant is assured in a simple manner without the space required for the charge igniter significantly reducing the chamber for the propellant.

SUMMARY OF THE INVENTION

In accordance with the invention, this object is accomplished by configuring the cartridge case as a charge igniter. Further, particularly advantageous embodiments of the invention are disclosed in the dependent claims.

The invention is essentially based on the concept of not arranging a separate charge igniter in the respective cartridge case, as in known ammunition, but using the cartridge case itself as the charge igniter. For this purpose, substances that form a pyrotechnical redox system are embedded in the material of the cartridge case. A particle-rich ignition of the main charge then takes place because of the strongly-reacting redox system. However, no nitrate/nitrite-containing oxygen carriers are suited as oxidizing agents. This is because nitrites ($NO_2$) are not stable enough to be stored, and nitrates ($NO_3$) are water-soluble, so a considerable manufacturing expenditure would be necessary for the production of corresponding cases, because the nitrites cannot be introduced into an aqueous pulp.

The redox system is preferably selected such that substances that are gentle to the barrel result as redox reaction products. This applies particularly to the use of titanium as a reducing agent and, for example, iron(III)-oxide as an oxidizing agent, because in this case primarily $TiO_2$ forms as a combustion product that additionally acts as an erosion-reducing additive.

The proportion of pyrotechnical additives should preferably be between 5 and 35 weight-%. The average grain size of the titanium is 6 to 12 μm, preferably 9 μm. The average grain size of the iron(III)-oxide is 0.1 to 25 μm, preferably 1 μm. In the use of the titanium/iron(III)-oxide system, the preferred mixture comprises approximately 50 weight-% Ti and approximately 50 weight-% $Fe_2O_3$. The average grain size of the titanium powder in this case should be approximately 9 μm, and that of the iron(III)-oxide should be between 0.1 and 20 μm.

Furthermore, those pyrotechnical redox systems are preferably selected which can be brought directly into the manufacturing process, i.e., into the aqueous pulp. This presupposes that the components of the redox system possess a certain thermal stability, an extensively inert behavior (resistance to corrosion) and insolubility during processing in aqueous systems. In addition to titanium, niobium metal powder, tantalum metal powder or zirconium metal powder, zirconium/nickel alloys and amorphous boron are considered as reducing agents. In addition to iron(III)-oxide, zinc peroxide, manganese(IV)-oxide and lead(IV)-oxide, among others, are suited as water-insoluble oxidizing agents.

In addition to the pyrotechnical additives, burn-regulating additives (moderators) such as sulfur, antimony(III)-sulfide or molybdenum(IV)-sulfide can be contained in the cartridge case.

BRIEF DESCRIPTION OF THE DRAWINGS

Further details and advantages of the invention ensue from the following embodiments explained by way of figures. Shown are in.

DESCRIPTION OF THE PREFERRED EMBODIMENTS

Figure 1:
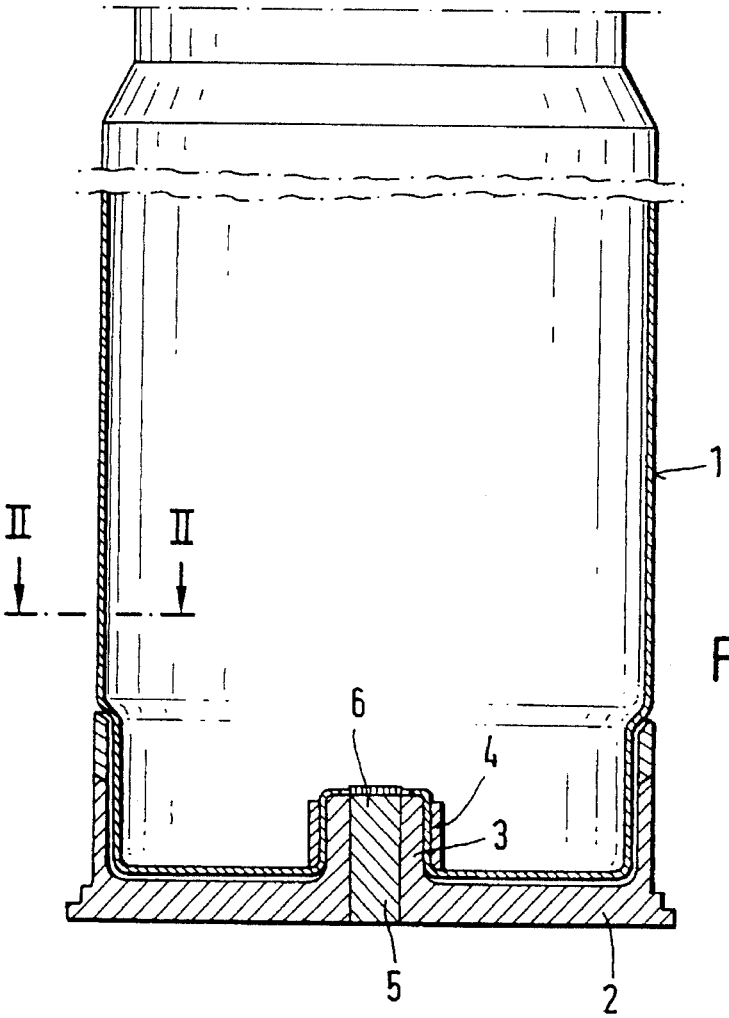
FIG. 1 the longitudinal section of a cartridge case of the invention that has a case bottom for cartridge ammunition, FIG. 2 an enlarged cross-section of a part of the cartridge case along the line indicated by II—II in FIG. 1, and FIG. 3 the longitudinal section of a propellant container for artillery ammunition.

In FIG. 1 a combustible cartridge case, as is conventionally used in large-caliber tank ammunition, is indicated by 1. The cartridge case 1 contains the propellant, not shown, and is connected at its upper end to a projectile (not shown) and at its lower end to a case bottom 2. The cartridge case surrounds a trunnion 3 of the case bottom 2 and is pressed against the trunnion 3 by means of a ring 4.

A primer element 5, which is in operational connection at the trunnion end 6 with the cartridge case 1 acting as a charge igniter, is further provided in the case bottom 2.

Figure 2:
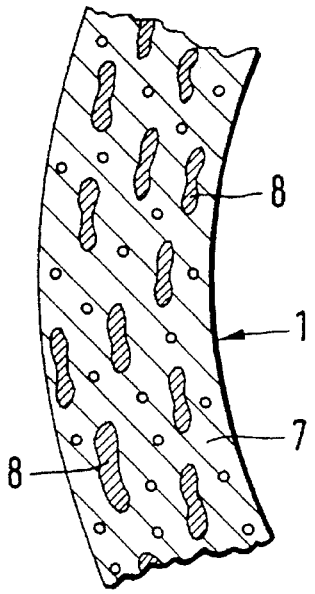

As shown in FIG. 2, the cartridge case 1 is made of the combustible case material 7, which is known per se, and a pyrotechnical mixture 8 of a redox system (if need be, with a burn-regulating additive). A mixture of titanium and iron(III)-oxide has performed particularly well as a redox system. Moreover, in addition to its ignition-supporting effect, this system produces primarily $TiO_2$ as a combustion product, which additionally acts as an erosion-reducing additive.

For the production of the cartridge case of the invention, the pyrotechnical mixture can be brought directly into the aqueous pulp, primarily comprising kraft paper and nitrocellulose, with the use of a suitable precipitating agent. The cartridge case can then be produced in a known way from this pulp.

Figure 3:
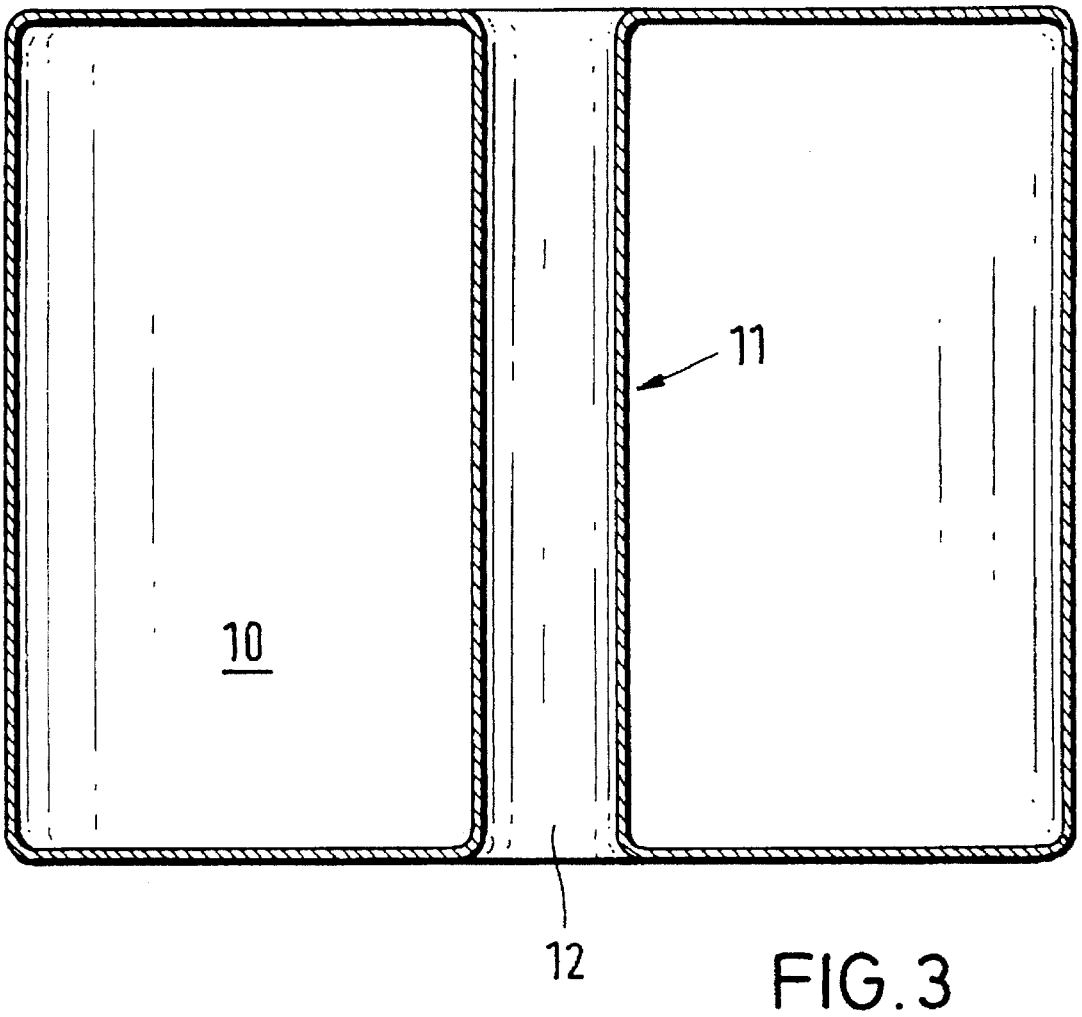

A further embodiment of the invention is illustrated in FIG. 3. This embodiment is of a propellant container 10 for artillery ammunition whose shape is known per se, and in which a cartridge case 11 surrounds the propellant (not shown). The design of the cartridge case corresponds to the design of the cartridge case 1 explained above in connection with FIG. 2.

The ignition conduit 12 typically provided with a charge igniter in known propellant containers can either remain open or be sealed with powder from the main charge.

What is claimed is:

1. In cannot ammunition including a cartridge case containing a propellant charge, a case bottom to which the cartridge case is connected, a charge igniter, and a primer element positioned in the case bottom, the improvement in which:

the cartridge case is combustible, is connected to the primer element, and comprises a combustible material and a pyrotechnical mixture which is embedded within the combustible material and which is comprised of at least one reducing agent and at least one oxidizing agent which form a pyrotechnical redox system; and the charge igniter consists of the cartridge case.

2. The cannot ammunition according to claim 1, wherein the at least one reducing agent is selected from the group consisting of niobium metal powder, tantalum metal powder, zirconium metal power, zirconium/nickel alloys, and amorphous boron, and wherein the at least one oxidizing agent is selected from the group consisting of iron(III)-oxide, zinc peroxide, manganese(IV)-oxide, and lead(IV)-oxide.

3. The cannot ammunition according to claim 2, wherein the cartridge case contains from 5 to 35 weight % of the pyrotechnical mixture.

4. The cannot ammunition according to claim 3, wherein the cartridge case further comprises at least one burn regulation agent selected from the group consisting of sulfur, antimony(III)-sulfide, and molybdenum(IV)-sulfide.

5. The cannot ammunition according to claim 1, wherein the cartridge case contains from 5 to 35 weight % of the pyrotechnical mixture.

6. The cannot ammunition according to claim 5, wherein the cartridge case further comprises at least one burn regulation agent selected from the group consisting of sulfur, antimony(III)-sulfide, and molybdenum(IV)-sulfide.

7. The cannon ammunition according to claim 1, wherein the cartridge case further comprises at least one burn regulation agent selected from the group consisting of sulfur, antimony(III)-sulfide, and molybdenum(IV)-sulfide.

8. In cannon ammunition including a cartridge case containing a propellant charge, a case bottom to which the cartridge case is connected, a charge igniter, and a primer element positioned in the case bottom, the improvement in which:

the cartridge case is combustible, is connected to the primer element, and comprises a combustible material and a pyrotechnical mixture which is embedded within the combustible material and which is comprised of titanium metal powder as a reducing agent and iron(III)-oxide as an oxidizing agent which form a pyrotechnical redox system; and the charge igniter consists of the cartridge case.

9. The cannon ammunition according to claim 8, wherein the titanium metal powder has an average grain size ranging from 6 to 12 μm.

10. The cannon ammunition according to claim 9, wherein the titanium metal powder has an average grain size of 9 μm.

11. The cannon ammunition according to claim 10, wherein the iron(III)-oxide has an average grain size ranging from 0.1 to 25 μm.

12. The cannon ammunition according to claim 11, wherein the iron(III)-oxide has an average grain size of 1 μm.

13. The cannon ammunition according to claim 12, wherein the cartridge case contains from 5 to 35 weight % of the pyrotechnical mixture.

14. The cannon ammunition according to claim 13, wherein the cartridge case further comprises at least one burn regulation agent selected from the group consisting of sulfur, antimony(III)-sulfide, and molybdenum(IV)-sulfide.

15. The cannon ammunition according to claim 8, wherein the iron(III)-oxide has an average grain size ranging from 0.1 to 25 μm.

16. The cannon ammunition according to claim 15, wherein the iron(III)-oxide has an average grain size of 1 μm.

17. The cannon ammunition according to claim 16, wherein the cartridge case contains from 5 to 35 weight % of the pyrotechnical mixture.

18. The cannon ammunition according to claim 17, wherein the cartridge case further comprises at least one burn regulation agent selected from the group consisting of sulfur, antimony(III)-sulfide, and molybdenum(IV)-sulfide.

19. The cannon ammunition according to claim 8, wherein the cartridge case contains from 5 to 35 weight % of the pyrotechnical mixture.

20. The cannon ammunition according to claim 19, wherein the cartridge case further comprises at least one burn regulation agent selected from the group consisting of sulfur, antimony(III)-sulfide, and molybdenum(IV)-sulfide.

21. The cannon ammunition according to claim 8, wherein the cartridge case further comprises at least one burn regulation agent selected from the group consisting of sulfur, antimony(III)-sulfide, and molybdenum(IV)-sulfide.

* * * * *

UNITED STATES PATENT AND TRADEMARK OFFICE

CERTIFICATE OF CORRECTION

PATENT NO. : 5,544,587
DATED : August 13, 1996
INVENTOR(S) : Stefan Thiesen et al It is certified that error appears in the above-indentified patent and that said Letters Patent is hereby corrected as shown below:

On the title page, item [57], line 4, "primmer" should read --primer--.

In the claims: in line 1 of claims 1, 2, 3, 4, 5 and 6, "cannot" should read --cannon--.

Signed and Sealed this

Twenty-ninth Day of October 1996

*Attest:*

Bruce Lehman

BRUCE LEHMAN

*Attesting Officer*

*Commissioner of Patents and Trademarks*